US011208312B2

(12) United States Patent
Zoni

(10) Patent No.: US 11,208,312 B2
(45) Date of Patent: Dec. 28, 2021

(54) MACHINE AND METHOD FOR PACKAGING POURABLE FOOD PRODUCTS

(71) Applicant: SIDEL PARTICIPATIONS, Octeville-sur-Mer (FR)

(72) Inventor: Roberto Zoni, Parma (IT)

(73) Assignee: SIDEL PARTICIPATIONS, Octeville-sur-mer (FR)

( * ) Notice: Subject to any disclaimer, the term of this patent is extended or adjusted under 35 U.S.C. 154(b) by 0 days.

(21) Appl. No.: 17/306,945

(22) Filed: May 4, 2021

(65) Prior Publication Data

US 2021/0339999 A1 Nov. 4, 2021

(30) Foreign Application Priority Data

May 4, 2020 (EP) ..... 20172828

(51) Int. Cl.
*B67C 7/00* (2006.01)
*B67C 3/04* (2006.01)
*B67C 3/02* (2006.01)

(52) U.S. Cl.
CPC ..... *B67C 7/0053* (2013.01); *B67C 3/023* (2013.01); *B67C 3/045* (2013.01); *B67C 7/002* (2013.01)

(58) Field of Classification Search
CPC ..... B67C 7/0053; B67C 3/045; B67C 7/002; B67C 3/023
See application file for complete search history.

(56) References Cited

U.S. PATENT DOCUMENTS 2,638,259 A 5/1953 Garrett
5,713,403 A * 2/1998 Clusserath ..... B65C 3/16 141/101
2012/0048423 A1* 3/2012 Loaec ..... B65B 43/60 141/94
2014/0373969 A1* 12/2014 Goldman ..... B67C 3/208 141/9
2018/0326623 A1 11/2018 Winzinger

FOREIGN PATENT DOCUMENTS

DE 4324799 A1 1/1995
DE 202016105439 U1 12/2016

OTHER PUBLICATIONS

European Search Report dated Sep. 4, 2020.

* cited by examiner

*Primary Examiner* — Jason K Niesz

(57) ABSTRACT

The present invention relates to a packaging method for packaging a pourable product in at least one container, by means of which it is obtained an improvement in the flexibility of the packaging machine configured for carrying out the method with regards to the type of the product which is to be packaged, and to a machine configured for carrying out the method.

16 Claims, 6 Drawing Sheets

MACHINE AND METHOD FOR PACKAGING POURABLE FOOD PRODUCTS

FIELD OF INVENTION

The present invention relates to a packaging method for packaging a pourable product in at least one container, by means of which it is obtained an improvement in the flexibility of the packaging machine configured for carrying out the method with regards to the type of the product which is to be packaged, and to a machine configured for carrying out the method.

BACKGROUND

In the general field of packaging machines for packaging a pourable product in containers, the machine comprises a conveyor supporting a plurality of containers and comprises a plurality of filling devices each configured for filling the container with the product by means of a filling process. The filling process can be of several types. For example, in the case of a still product, the filling process can be for example a not contact filling process, which can be considered for example a first type of the filling process. According to this first type, the container is not in contact with the filling device during the delivering of the product to the container. For example, in the case of a carbonated product, the filling process can be for example a contact filling process, which can be considered a second type. According to this second type, the container is in contact with the filling device during the delivering of the product to the container. For example, in the case of a hot fill product, the filling process can be for example a hot filling process, which can be considered a third type. According to this third type, the product is delivered to the container in a heated condition, in order to obtain the pasteurization of the container by means of the same product.

In general, the type of filling process depends on the type of product to be packaged.

Usually the filling devices are configured all for filling the respective containers by a filling process which is of the same type for all the filling devices, and the filling devices therefore are configured for the same type of product.

SUMMARY OF THE INVENTION

Present description relates to a packaging method for packaging a pourable product in at least one container, by means of which it is obtained an improvement in the flexibility of the packaging machine used for carrying out the method, with regards to the type of the product which is to be packaged.

A packaging method according to present description or according to any of the appended method claims obtains that objective of improving the flexibility of the machine.

Present description relates also to a packaging machine which is configured for carrying out the method according to present description.

A packaging machine according to any of the appended machine claims is configured to carry out a method according to any of the appended method claims.

The features of a method and a machine according to the present description will be clarified by the following not limiting description of respective exemplary respective embodiments of said method and machine according to the present description.

The following brief description of the drawings and detailed description are referred to a possible exemplary embodiment of a packaging method according to present description. In the following, with the term "method" it is intended said exemplary embodiment of the method.

The following brief description of the drawings and detailed description are referred to a possible exemplary embodiment of a packaging machine according to present description. In the following, with the term "machine" it is intended said exemplary embodiment of the machine.

The machine is configured for carrying out the method. The method is specially adapted to be carried out by the machine.

BRIEF DESCRIPTION OF THE DRAWINGS

Other features and advantages of the invention will become more clearly apparent on reading the following description of various embodiments, when taken in conjunction with the accompanying drawings.

DETAILED DESCRIPTION

Figure 1:
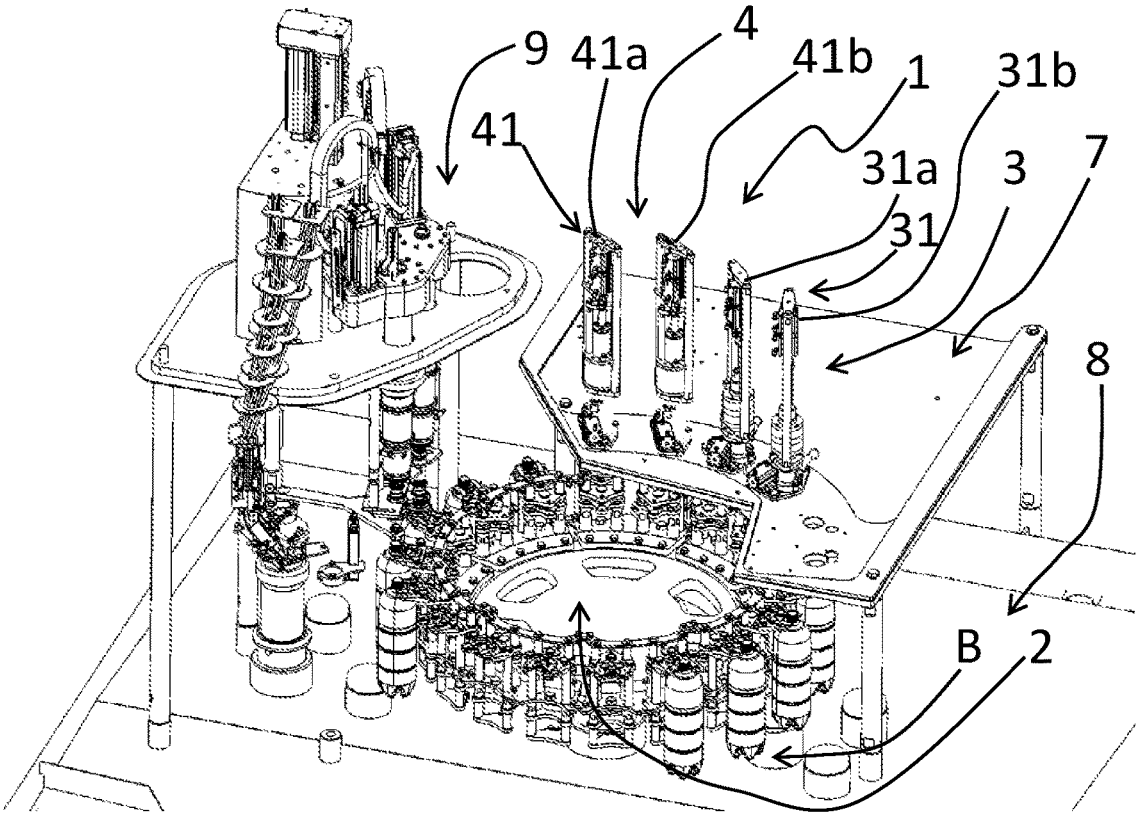
FIG. 1 is a perspective view of the machine.
Figure 2:
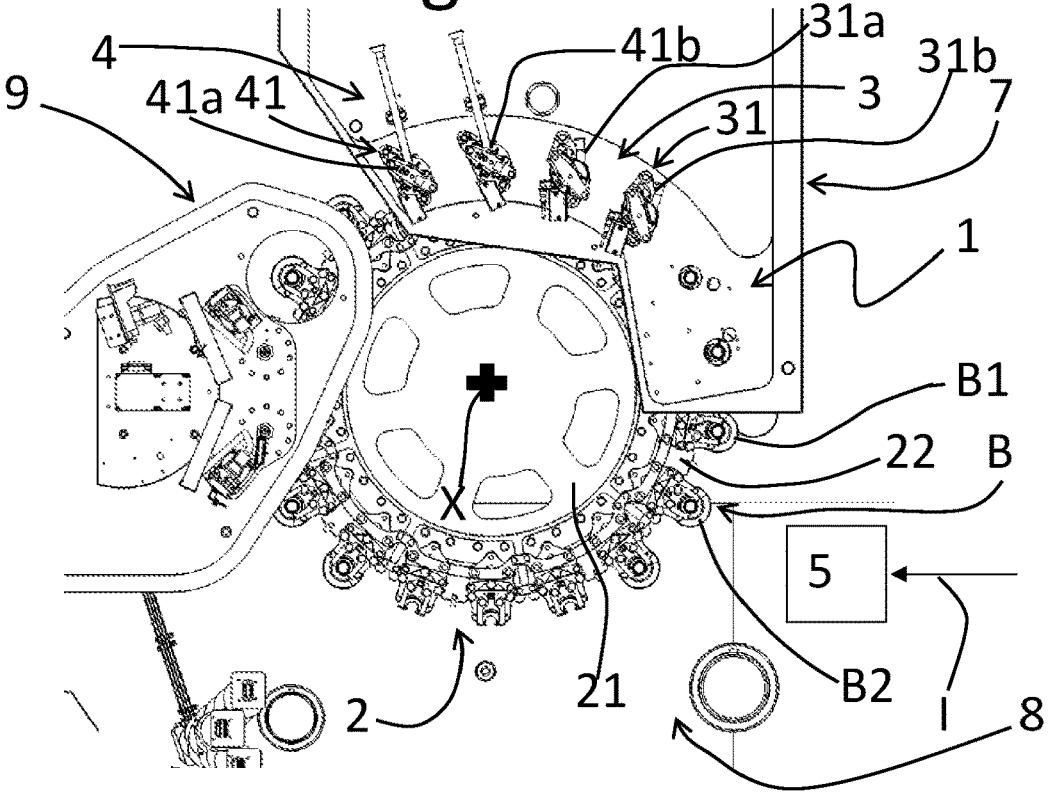
FIG. 2 is a view from above of the machine.

The machine is indicated in FIG. 1 and FIG. 2 with 1. The machine is for packaging a pourable product in at least one container B.

The pourable product can for example a food pourable product. The food pourable product can be for example a carbonated product, or a not carbonated product, which can be called a still product, or a hot fill product, which requires to be delivered to the at least one container B while it is in a hot condition.

The food pourable product can be water or any other kind of beverage.

The container B can be a receptacle of any kind, for example a bottle.

The machine comprises a first filling station 3. The first filling station 3 is configured for filling the at least one container B by means of a filling process of a first type.

The first filling station 3 comprises at least a filling device 31 configured for delivering the product to the at least one container B according to the first type of filling process.

The first type of filling process can be for example a not contact filling process (also called contactless filling process), according to which the at least one container B is not in contact with the at least one filling device 31 during the delivering of the product to the at least one container B. A not contact filling process can be employed for example in the case the product is a not carbonated or still product.

The first type of filling process can be for example a hot filling process, according to which the product is in a hot condition while being delivered to the at least one container B. This for example can be for pasteurizing the at least one container B by means of the same product.

The first type of filling process can be for example a contact filling process, according to which the at least one container B is in contact with the at least one filling device 31 during the delivering of the product to the at least one container B. A contact filling process can be employed for example in the case the product is a carbonated product.

The first filling station 3 is positioned at a first angular position around an axis X. The axis X is defined by the machine 1. The axis is indicated only in FIG. 2. The axis X is orthogonal to the plane of FIG. 2.

The machine comprises a second filling station 4. The second filling station 4 is configured for filling the at least one container B by means of a filling process of a second type. The second type can be for example a contact filling process. Anyway, the second type is different from the first type.

It is to be noted that the general category of not contact filling process and the general category of hot filling process can be not completely separated.

It is to be noted that the general category of contact filling process and the general category of hot filling process can be not completely separated.

The first type and the second type can both belong to the general category of contact filling process. In this case, the first type and the second type differ for at least a feature or parameter of the filling process.

It can be for example that the first type is a contact hot filling process and the second type is a contact filling process which is not also a hot filling process.

It can be for example that the first type is a not contact filling process and the second type is a contact filling process.

In general, the first type of filling process differs from the second type of filling process for said at least one feature or parameter of the filling process.

In general, the type of filling process depends on the type of product which is to be packaged.

The second filling station 4 is positioned at a second angular position around said axis X. The second angular position is different from the first angular position.

The machine 1 comprises a control unit 5. The control unit 5 is in communication with the filling stations 3 and 4. The control unit 5 is configured to carry out a preliminary selection phase. During the preliminary selection phase, one of the filling stations 3 and 4 is automatically selected as a function of an input I from a user. In general, the input I depends on the type of filling process, and therefore on the type of product which is to be packaged. The control unit 5 is schematically showed only in FIG. 2.

The first and second angular positions can be seen in FIGS. 1 and 2.

In the following it is considered as an example that the second filling station 4 is the selected station.

The at least one filling device 31 of the first station 3 can comprise for example a respective first filling device 31*a* and a respective second filling device 31*b*. The at least one filling device 41 of the second station 4 can comprise for example a respective first filling device 41*a* and a respective second filling device 41*b*.

In this case the at least one container B is to be considered as comprising a first container B1 and a second container B2. Each of the first container B1 and the second container B2 can be a receptacle of any kind, for example a bottle.

Each of the respective first filling device 31*a* and the respective second filling device 31*b* of the first station 3, is configured for delivering the product to the first container B1 and the second container B2, respectively, according to the first type of filling process.

Each of the respective first filling device 41*a* and the respective second filling device 41*b* of the second station 4, is configured for delivering the product to the first container B1 and the second container B2, respectively, according to the second type of filling process.

The machine 1 comprises an upper frame 7. The upper frame 7 is indicated in Figures from 1 to 6.

Figure 3:
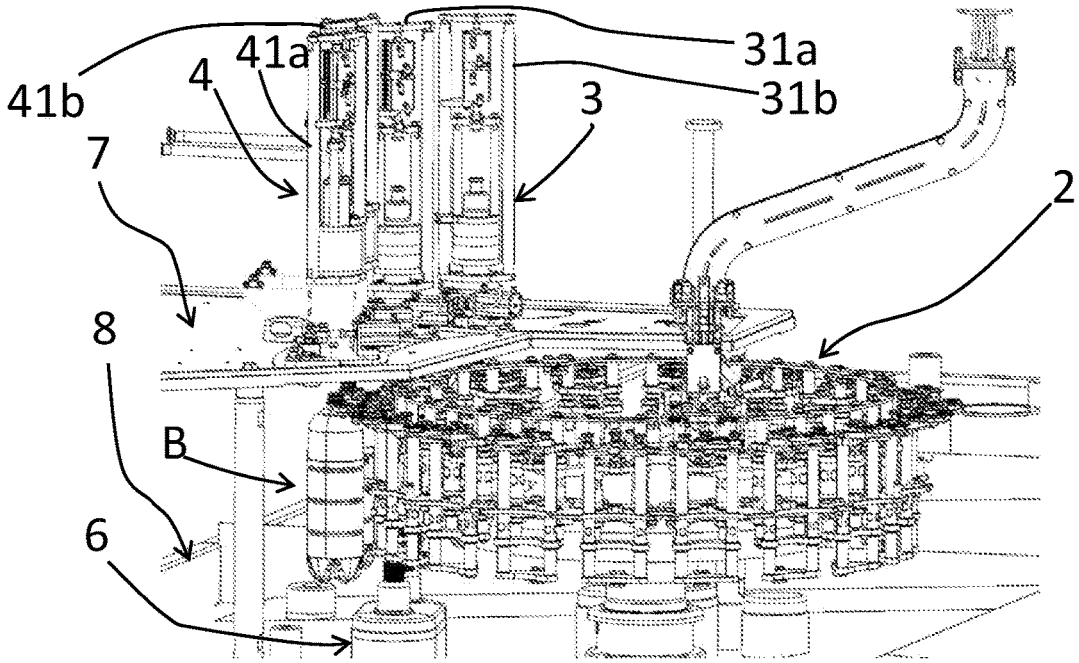
FIG. 3 is a perspective view of the filling stations of the machine.

The machine 1 comprises a lower frame 8. The lower frame 8 is indicated in FIGS. 1, 2, and 3.

The first station 3 is fixed in said first angular position by means of the upper frame 7.

The second station 4 is fixed in the second angular position by means of the upper frame 7.

The machine 1 comprises a conveyor 2. The conveyor is indicated in FIGS. 1 and 2.

The upper frame 7 is located, with respect to said axis X, at a higher height with respect to said conveyor 2.

The lower frame 8 is located, with respect to said axis X, at a lower height with respect to said conveyor 2.

The conveyor 2 is configured to carry out a transporting phase. During the transporting phase, by means at least of a stepwise rotational movement of the conveyor 2 around the axis X and with respect to the stations 3 and 4, the at least one container B is subsequently positioned in each of the stations 3 and 4.

The machine 1 is configured to carry out, as a function of said selection phase and during said transporting phase, a filling phase. During the filling phase, the at least one container B is filled with a pourable product. The filling phase is carried out by means of the selected station 4. The filling phase is carried out while the at least one container B is positioned in the selected station 4.

In this way, the flexibility of the machine 1, with regards to the type of product to be delivered to the at last one container B, is improved thanks to the possibility of switching very quickly between the first type of filling process and the second type of filling process, by changing the input I of the control unit 5.

Moreover, the fact that each of the filling stations 3 and 4 comprises more than one filling device increases the productivity of the machine 1.

The upper frame 7, which defines the first angular position of the first station 3 and the second angular position of the second station 4, allows for the first station 3 and the second station 4 to be in a correct position for carrying out the filling phase, without interfering with the movement of the conveyor 2. In this way the compactness of the machine 1 is improved. In this way the mechanical complexity of the machine 1 is also improved, because the machine 1 does not need complicated systems for allowing the stations 3 and 4 to adapt to the movement of the conveyor 2 in order to carry out the filling phase.

The machine 1 is configured so that the filling phase comprises a delivery phase, during which the product is delivered to the at least one container B by means of the at least one filling device 41 of the selected station 4.

More in particular, during the delivery phase, the product is delivered to the first container B1 by means of the respective first filling device 41*a* of the selected station 4, and the product is delivered to the second container B2 by means of the respective second filling device 41*b* of the selected station 4.

The delivery of the product to the first container B1 and the delivery of the product to the second container B2 are preferably carried out simultaneously, or at least partially simultaneously.

The machine 1 comprises a lifting device 6. The lifting device is indicated in FIGS. 3, 4, 5.

The machine 1 is configured so that the filling phase comprises, before the delivery phase, a lifting phase. During the lifting phase, the at least one container B, by means of the lifting device 6, is lifted until it is in contact with the at least one filling device 41 of the selected station 4.

FIG. 3 shows the at least one container B in a situation such that the at least one container B is in the selected station 4 and before the lifting phase, while the at least one container B adopts a lowered position with respect to the at least one filling device 41 of the selected station 4. More in particular, during the lifting phase, the first container B1 is lifted, by means of the lifting device 6, until it is in contact with the respective first filling device 41*a* of the selected station 4. More in particular, during the lifting phase, the second container B2 is lifted, by means of the lifting device 6, until it is in contact with the respective second filling device 41*b* of the selected station 4.

Figure 4:
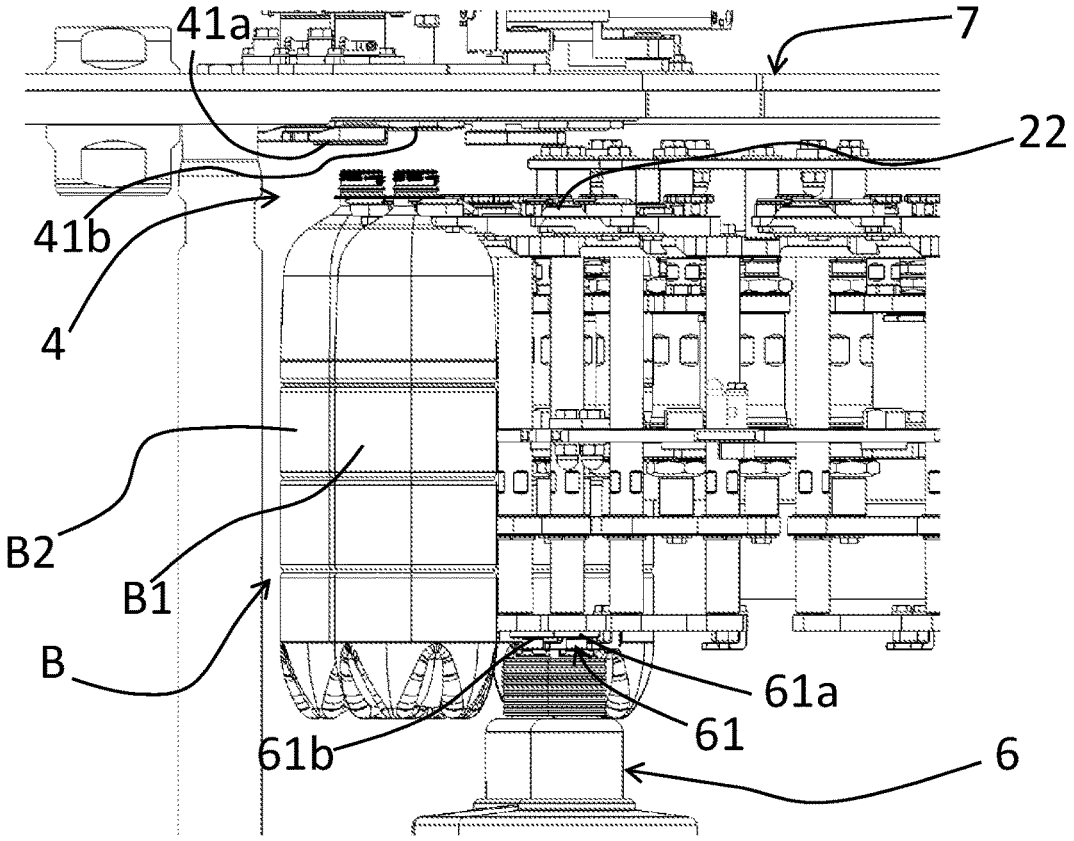
FIG. 4 is a detailed view of a second filling station of the machine, with at least one container adopting a lowered position in which the at least one container is not in contact with the second filling station.
Figure 5:
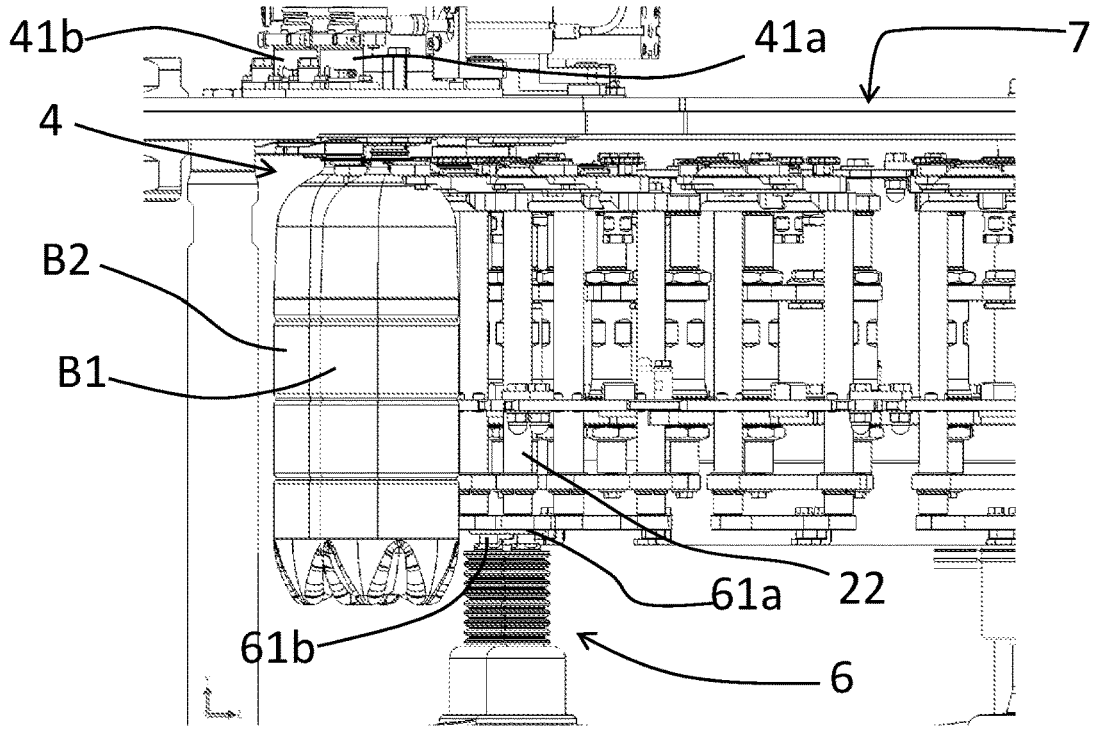
FIG. 5 is detailed view of the second filling station, with the at least one container adopting a lifted position in which the at least one container is in contact with the second filling station.

FIG. 4 shows the first container B1 and the second container B2 in a situation such that they are in the selected station 4 and before the lifting phase, while they are adopting a lowered position with respect to the respective first filling device 41*a* and second filling device 41*b* of the selected station 4, respectively. FIG. 5 shows the first container B1 and the second container B2 in a situation such that they are in the selected station 4 and after the lifting phase, while they are in a lifted position in which they are in contact with the respective first filling device 41*a* and second filling device 41*b* of the selected station 4, respectively.

Figure 6:
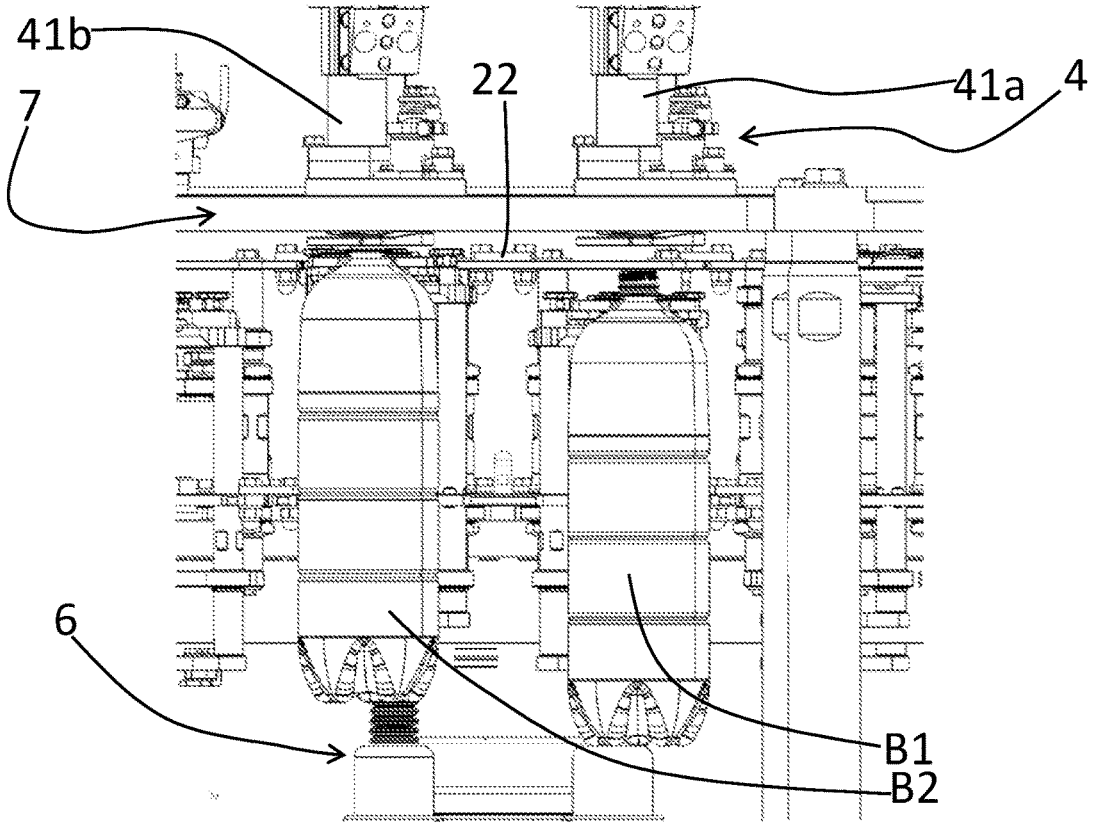
FIG. 6 is a view of the second filling station, with a first container of the at least one container adopting the lowered position and a second container of the at least one container adopting the lifted position.

FIG. 6 shows a situation in which the first container B1 is in the lowered position and the second container B2 is in the lifted position. It can be that the situation of FIG. 6 does not occur during the method.

However, the lifting of the first container B1 and the lifting of the second container B2 are carried out preferably simultaneously, or at least partially simultaneously.

The lifting device 6 is fixed in said second angular position by means of the lower frame 8. This allows for the lifting device 6 to be able to lift the a at least one container B without interfering with the movement of the conveyor 2, leading to a simplification of the mechanical complexity of the machine 1, because the machine 1 does not need complicated systems for avoiding interference between lifting device 6 and conveyor 2 and simultaneously allowing the lifting device 6 to carry out the lifting phase.

The conveyor 2 comprises a star 21. The star 21 is indicated in FIG. 2. The star 21 is coaxial with said axis X. The axis X can be considered an axis of the star 21. The conveyor comprises a retaining unit 22. The retaining unit 2 is mounted on the radial periphery of the star 21. The position of the retaining unit 22 on the radial periphery is showed in FIG. 2.

The retaining unit 22 is configured for carrying out a retaining phase. During the retaining phase, the at least one container B is retained by the retaining unit 22 at a radial periphery of the star 2.

The machine 1 is configured so that the transporting phase and filling phase are carried out during said retaining phase. Therefore, the positioning of the at least one container B in the first station 3 corresponds to the positioning of the retaining unit 22 in the first station 3 and the positioning of the at least one container B in the second station 4 corresponds to the positioning of the at least one container B in the second station 4.

The lifting device 6 comprises at least one lifting element 61. The lifting device 6 is configured so that the lifting phase is carried out by a motion of the retaining unit 22 with respect to the star 21. This motion comprises at least a translational component along a direction parallel to said axis X. The lifting device 6 is configured so that the motion of the retaining unit 22 is generated by the at least one lifting element 61.

In particular, the at least one lifting element 61 comprises a first lifting element 61*a* and a second lifting element 61*b*. The first lifting element 61*a* contributes to generate the motion of the retaining unit 22 on the side of the first container B1. The second lifting element 61*b* contributes to generate the motion of the retaining unit 22 on the side of the second container B2.

Figure 7:
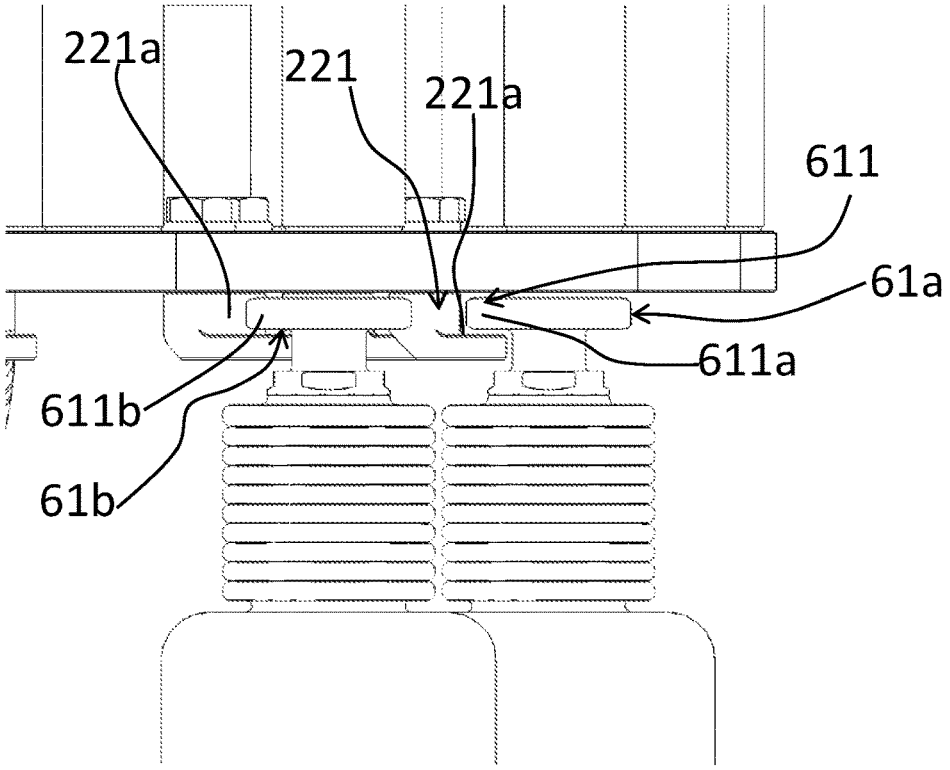
FIG. 7 is a detailed view of at least a protuberance integral with at least one lifting element of the second station, and of at least a groove integral with a retaining unit of a conveyor of the machine, with the first container and the second container adopting the lowered position.

The first lifting element 61*a* and the second lifting element 61*b* are indicated in FIGS. 4, 5 and 7.

The lifting device 6 is configured so that said motion is generated by means of a lifting action exerted by the at least one lifting element 61 on the retaining unit 22.

The retaining unit 22 and the at least one lifting element 61 comprise a at least one protuberance 611 and at least one groove 221. The at least one protuberance 611 is integral with the at least one lifting element 61*a* and the at least one groove 221 is integral with the retaining unit 22, or vice versa.

The lifting action is caused by an inserted position of the at least one protuberance 611 in the at least one groove 221.

The machine 1 is configured so that the positioning of the retaining unit 22 in the second station 4 corresponds to said inserted position of the at least one protuberance 611 in the at least one groove 221.

In this way the lifting device 61 can be used to lift the at least one container B in the case the second filling station 4 is the selected station 4, while allowing the retaining unit 2 to be positioned in the second station 4 without interfering with the lifting device 6 also in the case the second station 4 was not the selected station. Therefore, the switch between the first type of filling process to the second type of filling process can be very simple, because it does not require any complicated mechanical intervention on the machine 1.

In particular, the at least one protuberance 611 comprises a first protuberance 611*a* and a second protuberance 611*b*.

The first protuberance 611*a* and the second protuberance 611*b* are indicated in FIG. 7.

In particular, the at least one groove 221 comprises a first groove 221*a* and a second groove 221*b*.

The first groove 221*a* and the second groove 221*b* are indicated in FIG. 7.

The first protuberance 611*a* is integral with the first lifting element 61*a* and the first groove 221*a* is integral with the retaining unit 22, or vice versa.

The second protuberance 611*b* is integral with the second lifting element 61*b* and the second groove 221*b* is integral with the retaining unit 22, or vice versa.

The lifting action is caused by an inserted position of the first protuberance 611*a* in the first groove 221*a* and of the second protuberance 611*b* in the second groove 221*b*.

The machine 1 is configured so that the positioning of the retaining unit 22 in the second station 4 corresponds to the inserted position of the first protuberance 611*a* in the first groove 221*a* and to the inserted position of the second protuberance 611*b* in the second groove 221*b*.

The machine 1 comprises a capping station 9. The capping station 9 is indicated in FIGS. 1, 8, 9 and 10.

The capping station 9 is configured for carrying out a capping phase. The capping phase is carried out after the filling phase. During the capping phase, the at least one container B is capped by at least one closure C. The capping station 9 is positioned at a third angular position around said axis X. The third angular position is different from the first angular position and from the second angular position.

The conveyor 2 is configured so that the at least one container B is positioned, by means of said stepwise movement and after the filling phase, in the capping station 9.

The at least one closure C comprises a first closure C1 for capping the first container B1 and a second closure C2 for capping the second container B2.

The capping station 9 comprises a fork shaped transfer element 91. The transfer element 91 comprises a first arm 911*a* and a second arm 911*b*.

The capping station comprises a picking up substation 92. The capping station 9 is being configured so that the capping phase comprises a picking up phase. The picking up phase is carried out in the picking up substation 92. During the picking up phase, the transfer element 91 picks up at least the first closure C1 and the second closure C2 by means of the first arm 911 and the second arm 911*b*, respectively.

The picking up substation 92 comprises a distributor 921 configured for distributing at least the first closure C1 and the second closure C2.

During the picking up phase, the transfer element 91 detaches from the distributor 921 at least the first closure C1 and the second closure C2, by means of the first arm 911 and the second arm 911*b*, respectively.

The capping station 9 comprises an applying substation 93. The capping station 9 is configured so that the capping phase comprises an applying phase. The applying phase is carried out in the applying substation 93. The applying substation comprises a first capping head 931*a* and a second capping head 931*b*. During the applying phase, the first closure C1 is applied on the first container B1 by means of the first capping head 931*a*. During the applying phase, the second closure C2 is applied on the second container B2 by means of the second capping head 931*b*.

The capping station 9 is configured so that the capping phase comprises a transfer phase. During the transfer phase, the transfer element 91, by means of a displacement of the transfer element 91, transfers at least the first closure C1 and the second closure C2 from the picking up substation 92 to the applying substation 93. The fork shaped element 91 allows for picking up the first closure C1 and the second closure C2 in such a way to allow the capping of the first container B1 and of the second container B2 to be carried out simultaneously or at least partially simultaneously. In this way it is improved the productivity of the machine 1 provided also with the capping station 9.

Figure 8:
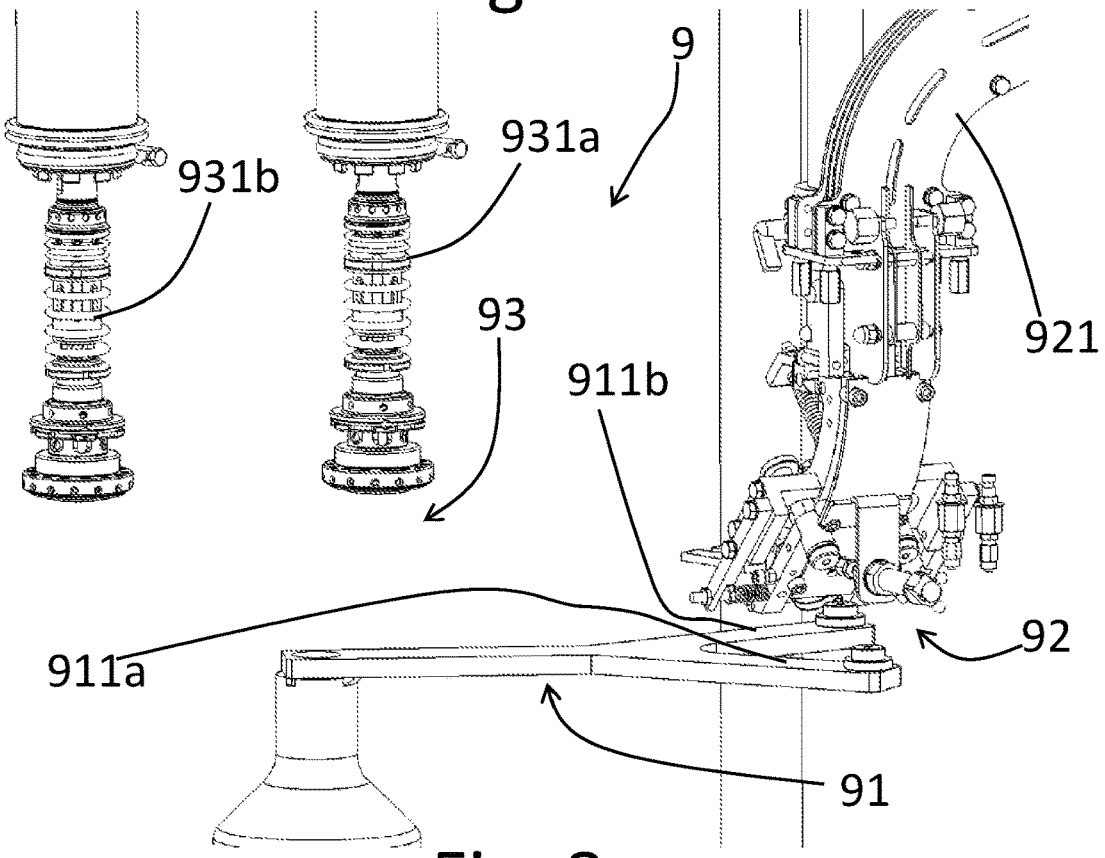
FIG. 8 is a detailed view of a capping station of the machine, with a transfer element of the capping station adopting a first position with respect to an applying substation and a picking up substation of the capping station.
Figure 9:
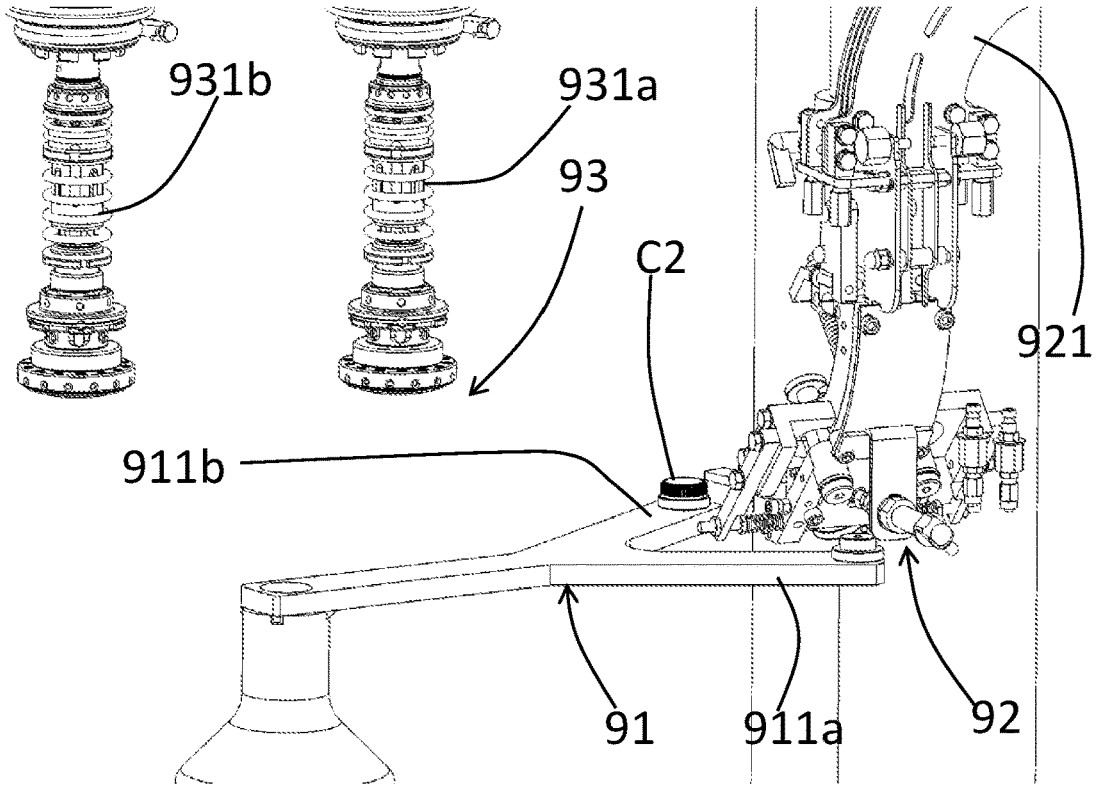
FIG. 9 is a detailed view of the capping station of the machine, with a transfer element of the capping station adopting a second position with respect to the applying substation and to the picking up substation of the capping station.
Figure 10:
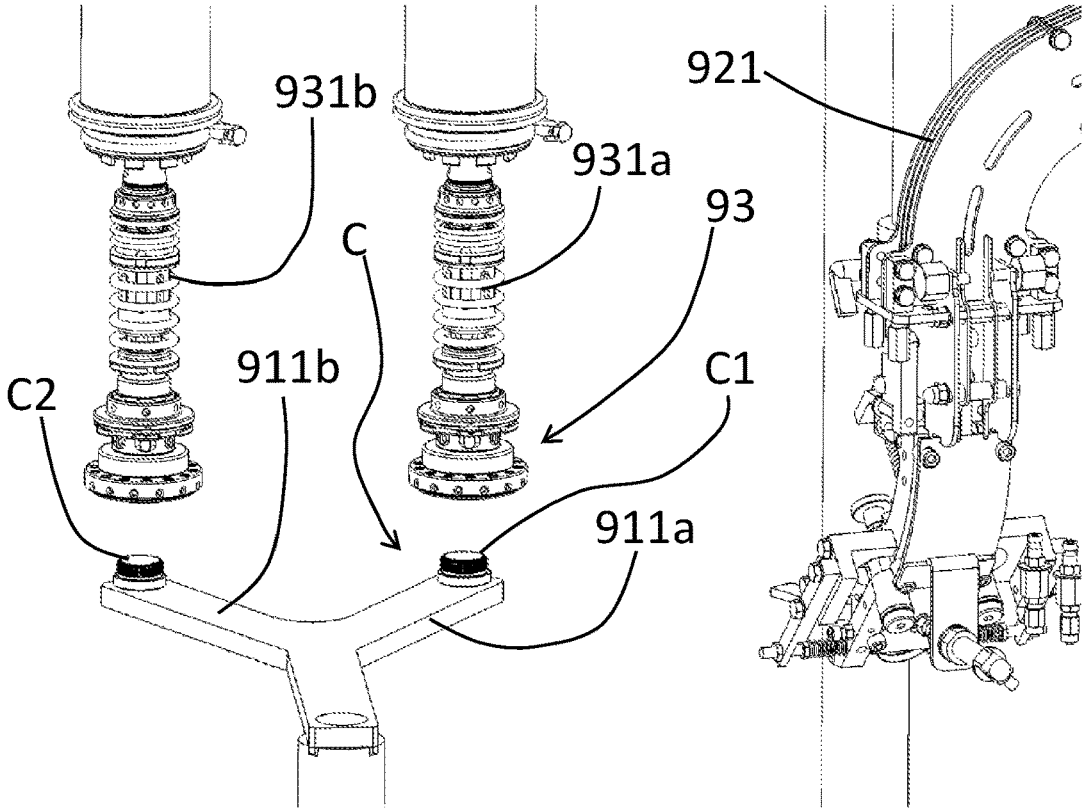
FIG. 10 is a detailed view of the capping station of the machine, with a transfer element of the capping station adopting a third position with respect to the applying substation and to the picking up substation of the capping station.

The capping station 9 is configured so that the transfer element 91 picks up at least said second closure C2 and first closure C1, one after the other. In FIG. 8 the transfer element 91 is in the picking up substation 92 and has not yet picked up any of the first closure C1 and the second closure C2. In FIG. 10 the transfer element 91 is in the applying substation 93. In FIG. 9 the transfer element 91 has picked up the second closure C2 but has not already picked up the first closure C1.

The capping station 9 is configured so that the transfer element 9 picks up the first closure C1 while the transfer element 91 is being subjected to the displacement from the picking up substation 92 and the applying substation 93. The situation of FIG. 9 can be considered while the transfer element 91 is ready to detach also the first closure C1 from the distributor 921 during said displacement.

In this way the distributor can distribute one closure at a time. Therefore, the mechanical complexity of the capping station 9 and then of the machine 1 is reduced.

The transfer element 91 can be for example Y-shaped. This allows for the displacement of the transfer element to be a rotation, in order to save space.

Figure 11:
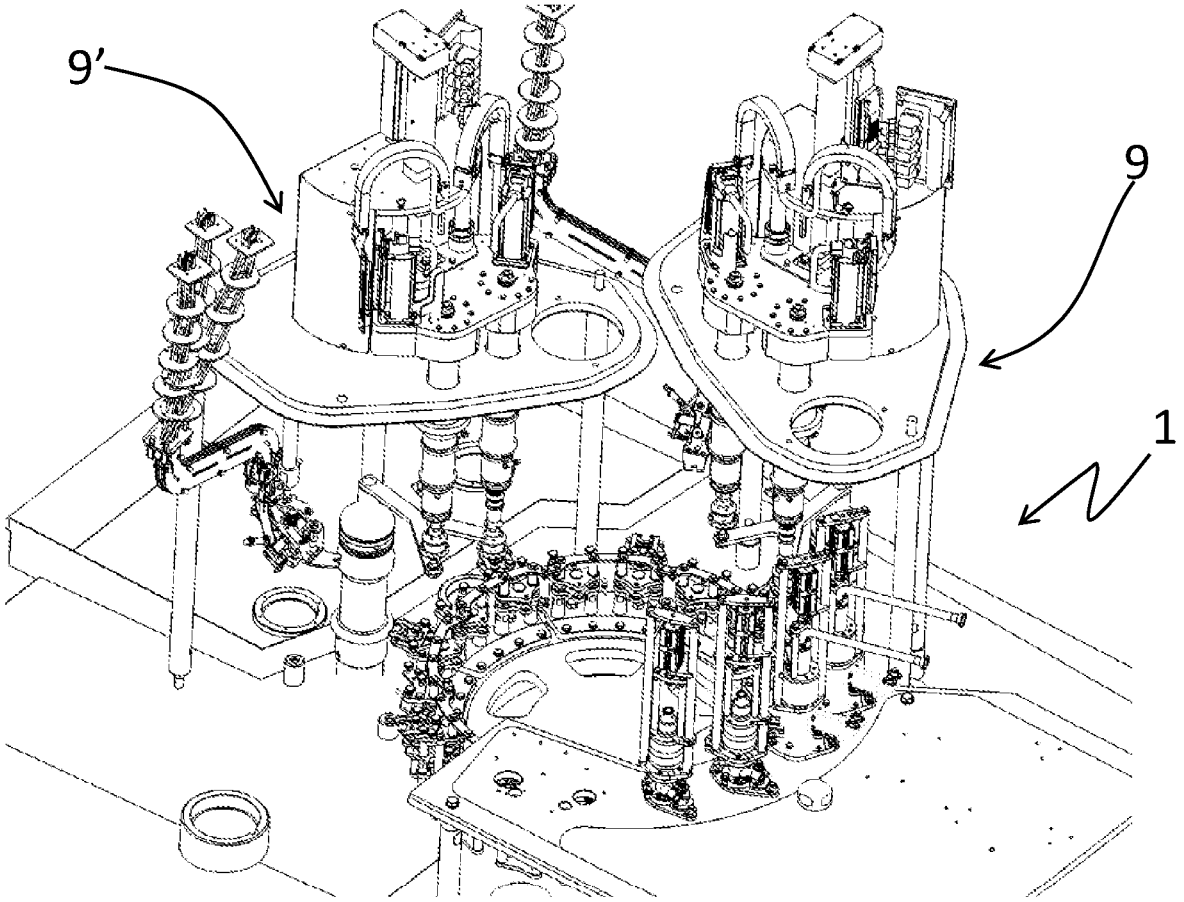
FIG. 11 is a perspective view of the machine showing a possible further feature of the machine.

The machine can comprise a further capping station 9'. This can improve the productivity of the machine. This option is showed in FIG. 11.

The further capping station 9' can have one or more of the features of the capping station 9, or all the features of the capping station 9.

The machine 1 can be configured so that the rotation of the transfer element of the capping station 9 and the rotation of the transfer element of the further capping station 9' are opposed to each other. In this way it is obtained a reduction of the space required by the machine 1 to define the path from the input, where the machine 1 receives the at least one container B, to the output, where the machine release the at least one container B.

The method comprises the phases described above.

Clearly, changes may be made to the machine 1 and method, without, however, departing from the scope of protection as defined in the accompanying claims.

The invention claimed is:

1. Packaging machine (1) for packaging a pourable product in at least one container (B), comprising:

a first filling station (3) configured for filling the at least one container (B) by means of a filling process of a first type, the first station (3) being positioned at a first angular position around an axis (X), said axis (X) being defined by the machine (1);

a second filling station (4) configured for filling the at least one container (B) by means of a filling process of a second type which is different from the first type, said second station (4) being positioned at a second angular position around said axis (X) and the second type being a contact filling process, said second angular position being different from said first angular position;

a control unit (5) connected to said filling stations (3, 4) and configured to carry out a preliminary selection phase during which one of the filling stations (3, 4) is automatically selected as a function of an input (I) from a user; and a conveyor (2) configured to carry out a transporting phase, during which, by means at least of a stepwise rotational movement of the conveyor (2) around said axis (X) and with respect to said stations (3, 4), the at least one container (B) is subsequently positioned in each of said stations (3, 4);

wherein the machine (1) is configured to carry out, as a function of said selection phase and during said transporting phase, a filling phase, during which the at least one container (B) is filled with a pourable product, said filling phase being carried out by means of the selected station (4) and while the at least one container (B) is positioned in the selected station (4).

2. Machine (1) according to claim 1, comprising a further capping station (9').

3. Machine (1) according to claim 1, wherein said first type is a hot filling process.

4. Machine (1) according to claim 1, wherein:

the machine (1) comprises a capping station (9) configured for carrying out a capping phase, during which, after the filling phase, the at least one container (B) is capped by at least one closure, the capping station (9) being positioned at a third angular position around said axis (X), the third angular position being different from said first angular position and from second angular position;

the conveyor (2) is configured so that the at least one container (B) is positioned, by means of said stepwise movement and after the filling phase, in the capping station (9); and wherein:

the at least one container (B) comprises a first container (B1) and a second container (B2);

the at least one closure (C) comprises a first closure (C1) for capping the first container (B1) and a second closure (C2) for capping the second container (B2).

5. Machine (1) according to claim 4, wherein the capping station (9) comprises:

a fork shaped transfer element (91) comprising two arms (911*a*, 911*b*);

a picking up substation (92), the capping station (9) being configured so that the capping phase comprises a picking up phase during which, in said picking up substation (92), the transfer element (91) picks up at least the two closures (C1, C2) by means of the two arms (911*a*, 911*b*), respectively;

an applying substation (93), the capping station (9) being configured so that the capping phase comprises an applying phase during which, in said applying substation (93), at least the first closure (C1) and the second closure (C2) are applied on at least the first container (B1) and the second container (B2), respectively;

the capping station (9) being configured so that the capping phase comprises a transfer phase, during which the transfer element (91), by means of a displacement of the transfer element (91), transfers at least the first closure (C1) and the second closure (C2) from the picking up substation (92) to the applying substation (93).

6. Machine (1) according to claim 5, wherein the capping station (9) is configured so that the transfer element (91) picks up at least said second closure (C2) and first closure (C1), one after the other, and picks up at least the first closure (C1) while the transfer element (91) is being subjected to said displacement.

7. Machine (1) according to claim 1, wherein:

each of said stations (3, 4) comprises a respective at least one filling device (31; 41) for delivering the product according to the respective type of filling process, the machine being configured so that the filling phase comprises a delivery phase, during which the product is delivered to the container (B) by means of the at least one filling device (31; 41) of the selected station;

the machine (1) comprises a lifting device (6) and is configured so that the filling phase comprises, before the delivery phase, a lifting phase, during which the at least one container (B), by means of the lifting device (6), is lifted until it is in contact with the at least one filling device (41) of the selected station (4).

8. Machine (1) according to claim 7, comprising:

an upper frame (7) which is located, with respect to said axis (X), at a higher height with respect to said conveyor (2);

a lower frame (8) which is located, with respect to said axis (X), at a lower height with respect to said conveyor (2);

wherein the first station (3) is fixed in said first angular position by means of said upper frame (7); and wherein the second station and the lifting device (6) are fixed in said second angular position by means of the upper frame (7) and the lower frame (8), respectively.

9. Machine (1) according to claim 8, wherein:

the conveyor (2) comprises a star (21) coaxial with said axis (X) and a retaining unit (22) mounted on the radial periphery of said star (21), the retaining unit (22) being configured for carrying out a retaining phase, during which the at least one container (B) is retained by the retaining unit at a radial periphery of the star (2); and wherein:

the machine (1) is configured so that said transporting phase and filling phase are carried out during said retaining phase, so that the positioning of the at least one container (B) in each of said stations (3, 4) corresponds to the positioning of the retaining unit (22) in the same station (3; 4);

the lifting device (6) comprises at least one lifting element (61) and is configured so that said lifting phase is carried out by said at least one lifting element (61) generating a motion of the retaining unit (22) with respect to the star (21), said motion comprising at least a translational component along a direction parallel to said axis (X).

10. Machine (1) according to claim 9, wherein:

the lifting device (6) is configured so that said motion is generated by means of a lifting action exerted by the at least one lifting element (61) on the retaining unit (22), the lifting action being caused by an inserted position of at least one protuberance (611) in at least one groove (221), the at least one protuberance (611) being integral with the at least one lifting element (61) and the at least one groove (221) being integral with the retaining unit (22), or vice versa; and the machine (1) is configured so that the positioning of the retaining unit (22) in the second station (4) corresponds to said inserted position.

11. Packaging method for packaging a pourable product in at least one container (B), comprising:

providing a first filling station (3) configured for filling the at least one container (B) by a first type filling process and positioned at a first angular position around an axis (X);

providing a second filling station (4) configured for filling the at least one container (B) by a second type filling process and positioned at a second angular position around said axis (X), the second type being different from the first type and being a contact filling process, said second angular position being different from said first angular position;

selecting, automatically, during a preliminary selection phase, one of the filling stations (3, 4) as a function of an input (I) from a user;

positioning, during a transporting phase, the at least one container (B) subsequently in each of said stations (3, 4);

filling, during a filling phase that is a function of said selection phase and during said transporting phase, the at least one container (B) with a pourable product, said filling phase being carried out by means of the selected station (4) and while the at least one container (B) is positioned in the selected station (4).

12. Method according to claim 11, wherein:

each of said stations (3, 4) comprises a respective at least one filling device (31; 41) for delivering the product according to the respective type of filling process, the filling phase comprising a delivery phase, during which the product is delivered to the at least one container (B) by means of the at least one filling device (41) of the selected station;

the filling phase comprises, before the delivery phase, a lifting phase, during which the at least one container (B), by means of the lifting device (6), is lifted until it is in contact with the at last one filling device (41) of the selected station (4).

13. Method according to claim 12, further comprising:

retaining, during a retaining phase, at least one container (B) by the retaining unit (22) mounted on a radial periphery of a transporting star (21) which is coaxial with said axis (X);

wherein:

said transporting phase and filling phase are carried out during said retaining phase, so that the positioning of the at least one container (B) in each of said stations (3, 4) corresponds to the positioning of the retaining unit (22) in the same station (3; 4);

said lifting phase is carried out by at least one lifting element (61) generating a motion of the retaining unit (22) with respect to the star (21), said motion comprising at least a translational component along a direction parallel to said axis (X).

14. Method according to claim from 11, further comprising:

providing a capping station (9) positioned at a third angular position around said axis (X) so that, during said transporting phase and after the filling phase, the at least one container (B) is positioned in the capping station (9), the third angular position being different from said first angular position and from second angular position;

capping, using the capping station, during a capping phase after the filling phase, the at least one container (B) by at least one closure (C);

wherein:

the at least one container (B) comprises a first container (B1) and a second container (B2);

the at least one closure (C) comprises a first closure (C1) which caps the first container (B1) following the capping phase and a second closure (C2) which caps the second container (B2) following the capping phase.

15. Method according to claim 14, wherein the capping phase (9) comprises:

a picking up phase during which, in a picking up substation (92), a fork shaped transfer element (91) picks up at least the first closure (C1) and the second closure (C2) by means of first arm (911*a*) and the second arm (911*b*) of the transfer element (91), respectively;

an applying phase during which, in an applying substation (93), the at least the first closure (C1) and the second closure (C2) are applied on at least the first container (B1) and the second container (B2), respectively;

a transfer phase, during which the transfer element (91), by means of a displacement of the transfer element (91), transfers at least the first closure (C1) and the second closure (C2) from the picking up substation (92) to the applying substation (93).

16. Machine (1) according to claim 15, wherein the transfer element (91) picks up at least said second closure (C2) and first closure (C2) one after the other and picks up at least the first closure (C1) while the transfer element (91) is being subjected to said displacement.

* * * * *